United States Patent [19]

Trost et al.

[11] 4,040,451

[45] Aug. 9, 1977

[54] TRIAXIAL WEAVING MACHINE HAVING HEDDLES WITH WEFTWISE LATERAL PROJECTIONS

[75] Inventors: Wayne C. Trost, Rockford; John B. Capps, Forreston, both of Ill.

[73] Assignee: Barber-Colman Company, Rockford, Ill.

[21] Appl. No.: 716,825

[22] Filed: Aug. 23, 1976

[51] Int. Cl.[2] ..... D03C 13/00

[52] U.S. Cl. ..... 139/48; 139/DIG. 1

[58] Field of Search ..... 139/39, 48, DIG. 1, 139/436

[56] References Cited

U.S. PATENT DOCUMENTS 3,809,130 5/1974 Strauss et al. ..... 139/436

3,965,939 6/1976 Kulczycki et al. ..... 139/DIG. 1

*Primary Examiner*—Henry S. Jaudon

*Attorney, Agent, or Firm*—Bell, Seltzer, Park & Gibson

[57] ABSTRACT

A weaving machine for making triaxial fabrics in which heddles are positioned in weftwise rows of parallel heddles, moved longitudinally during warp shed formation, and shifted weftwise. Heddles of the weaving machine of this invention have means thereon for preventing entrance of more than one heddle into the same passageway, in the form of weftwise lateral projections for engagement with an adjacent heddle so as to facilitate proper guidance of heddles in the weftwise row into guiding passageways during longitudinal movement and weftwise shifting of the heddles.

9 Claims, 4 Drawing Figures

TRIAXIAL WEAVING MACHINE HAVING HEDDLES WITH WEFTWISE LATERAL PROJECTIONS

This invention relates to an improved machine for weaving triaxial fabrics and, more particularly, to improvements over the heddle invention which is the subject matter of copending U.S. patent application Ser. No. 582,246 filed May 30, 1975 now U.S. Pat. No. 3,985,160 issued Oct. 12, 1976 and the weaving machine invention which is the subject matter of copending U.S. application Ser. No. 603,657 filed Aug. 11, 1975, now U.S. Pat. No. 3,999,578 issued Dec. 28, 1976, both owned in common with the present invention.

As described more fully in the aforementioned copending applications, triaxial fabrics are generally characterized by including at least two sets of warp strands interwoven with weft strands, with one of the sets of warp strands crossing the other and both sets of warp strands extending diagonally of the length of the fabric. Various weaving machine and heddle configurations, including those more particularly described in the aforementioned related applications, have heretofore been proposed for accommodating control over warp strand positioning during the weaving of triaxial fabric. While such previously proposed heddles and weaving machine arrangements have successfully accomplished the weaving of triaxial fabrics, occasional difficulty has been encountered in assuring maintenance of parallelism of heddles in weftwise rows during longitudinal movement and weftwise shifting. Such difficulties have manifested themselves in dislocation of heddles in the weftwise rows with occasional consequences jamming of excessive numbers of heddles into a common guiding passageway of a weaving machine.

It is an object of the present invention to avoid misalignment, jamming and other difficulties with heddles arranged in weftwise rows through the provision of weftwise lateral projections on the heddles which prevent entrance of more than one heddle into the same passageway. In realizing this object of the present invention, a heddle is provided with means projecting laterally for blocking engagement with an adjacent heddle in the same weftwise row in the event of heddle misalignment.

This object of the invention having been stated, other objects will appear as the description proceeds, when taken in connection with the accompanying drawings, in which FIG. 1 is a perspective view of the improved heddle of the present invention, including weftwise lateral projections for guiding engagement with an adjacent heddle;

Figure 1:
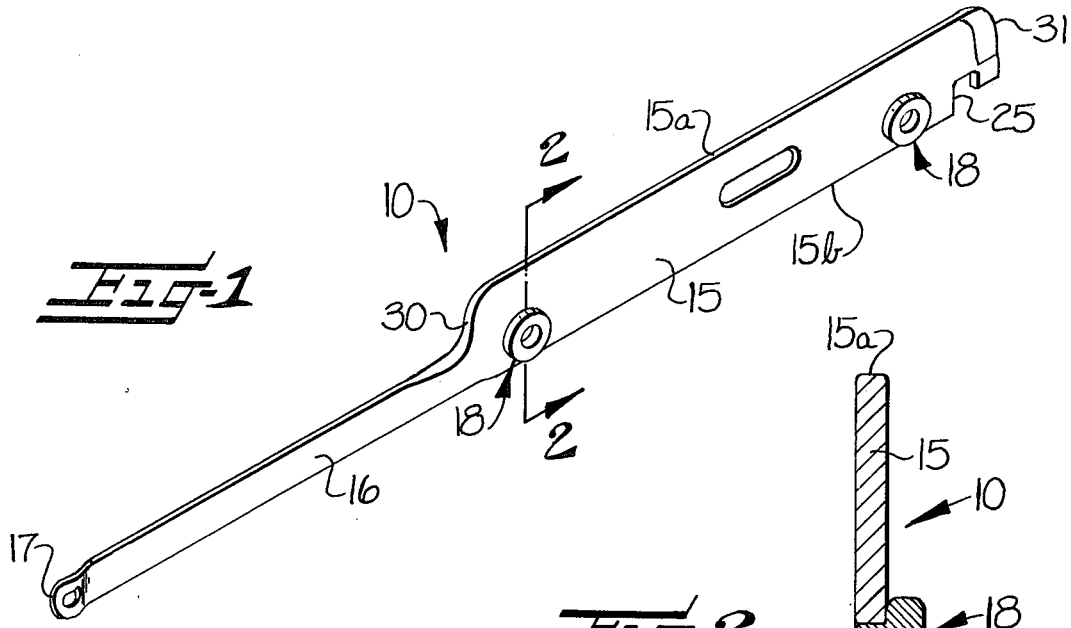
Figure 2:
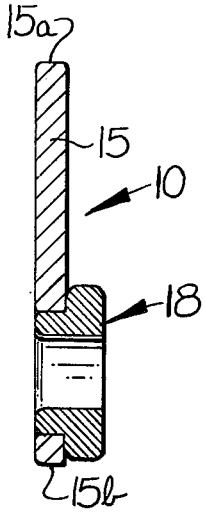
FIG. 2 is an enlarged elevation view, in section, taken generally along the line 2—2 in FIG. 1.

Referring now more particularly to the accompanying drawing, the heddle of the present invention is particularly shown in FIGS. 1 and 2 and is identified generally at 10 throughout the series of views. As described more fully in aforementioned copending application Ser. No. 582,246, which is hereby incorporated by reference into this description to the extent necessary for full understanding of this invention, the heddle 10 has at least a medial portion which defines a body portion 15 with spaced apart edges 15*a*, 15*b* extending longitudinally of the heddle. The heddle further includes an elongate reduced width frontal portion 16 extending forwardly from the body portion 15 and terminating in a nose portion 17. The pair of spaced apart edges 15*a*, 15*b* and the body portion 15 of the heddle 10 define a principal plane for the heddle. In the preferred form, the heddle 10 is formed of a suitable strip material such as steel, with the strip material of the body portion 15 of the heddle lying in the principal plane. As is fully described in the aforementioned copending application, the body portion of the heddle 10 serves to define a means by which the heddle may be shifted weftwise by the operation of a heddle shifting means generally indicated in FIG. 3 Further, the heddle 10 has, adjacent a rear edge 31 remote from the nose portion 17, a cut-out 25 which cooperates with shed forming means generally indicated in FIG. 3 for longitudinal movement of the heddle during warp shed formation.

Figure 4:
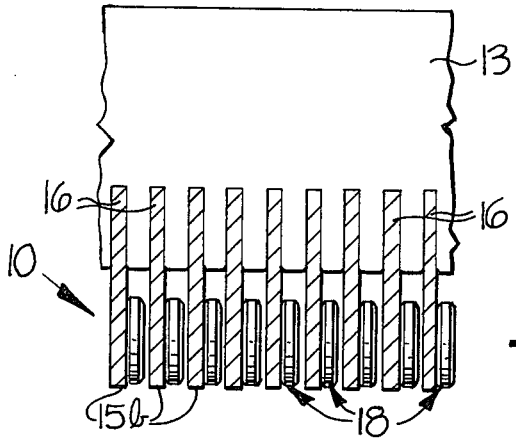
FIG. 4 is a partial elevation view, in section, taken generally along the line 4—4 in FIG. 3.

In accordance with the present invention, the heddle comprises means generally indicated at 18 projecting weftwise laterally for preventing entrance of more than one heddle into the same passageway by guiding engagement with an adjacent heddle as may be required during longitudinal movement and weftwise shifting. As illustrated, the means 18 projecting weftwise laterally preferably projects outwardly from only one lateral side of the principal plane of the heddle 10 (FIGS. 2 and 4). The other lateral side of the principal plane of the heddle 10 defines at least one planar surface area lying substantially on the principal plane for engagement with the laterally projecting means 18 of an adjacent heddle.

In order to facilitate maintenance of heddles in a weftwise row in parallel relation in both retracted open shed and extended open shed positions, as the heddles move longitudinally relative to other elements of the triaxial weaving machine, it is preferred that the means 18 projecting weftwise laterally comprise a plurality of projections spaced one from another longitudinally along the heddle 10. As illustrated, the means 18 takes the particular form of button means secured to and projecting laterally from the body portion of the heddle 10. Preferably, the button means are formed of a material having a hardness less than that of the strip material of the heddle, so as to facilitate minimizing wear of the strip material. Where the heddle 10 is formed of steel, a suitable material for the button means has been found to be brass.

As will be noted from the accompanying drawing, the button means projecting weftwise laterally from the heddle 10 are positioned in particular relationship with various elements of the heddle. More particularly, the button means are spaced widthwise of the body portion 15 of the heddle more closely to one parallel edge 15*b* than to the other edge 15*a*. Desirably, the button means are in substantial longitudinal alignment with the reduced width frontal portion 16. With respect to the longitudinal spacing between the button means, the button means are desirably spaced longitudinally inwardly of both a front shoulder edge 30 and the rear edge 31 of the body portion 15 of the heddle 10. The provision of a plurality of button means on each heddle and the alignment and spacing mentioned hereinabove are of particular significance in assuring cooperation with means defining guiding passageways as described hereinafter. More specifically, positioning of the button means in substantial alignment with the frontal portion 16 avoids frictional engagement thereof with the passageway means. Further, positioning of a pair of button means, one spaced inwardly from each of the front and rear edges 30, 31 brings whichever button means is leading during heddle movement to and from extended and retracted open shed positions into play to block any incipient heddle jamming.

Figure 3:
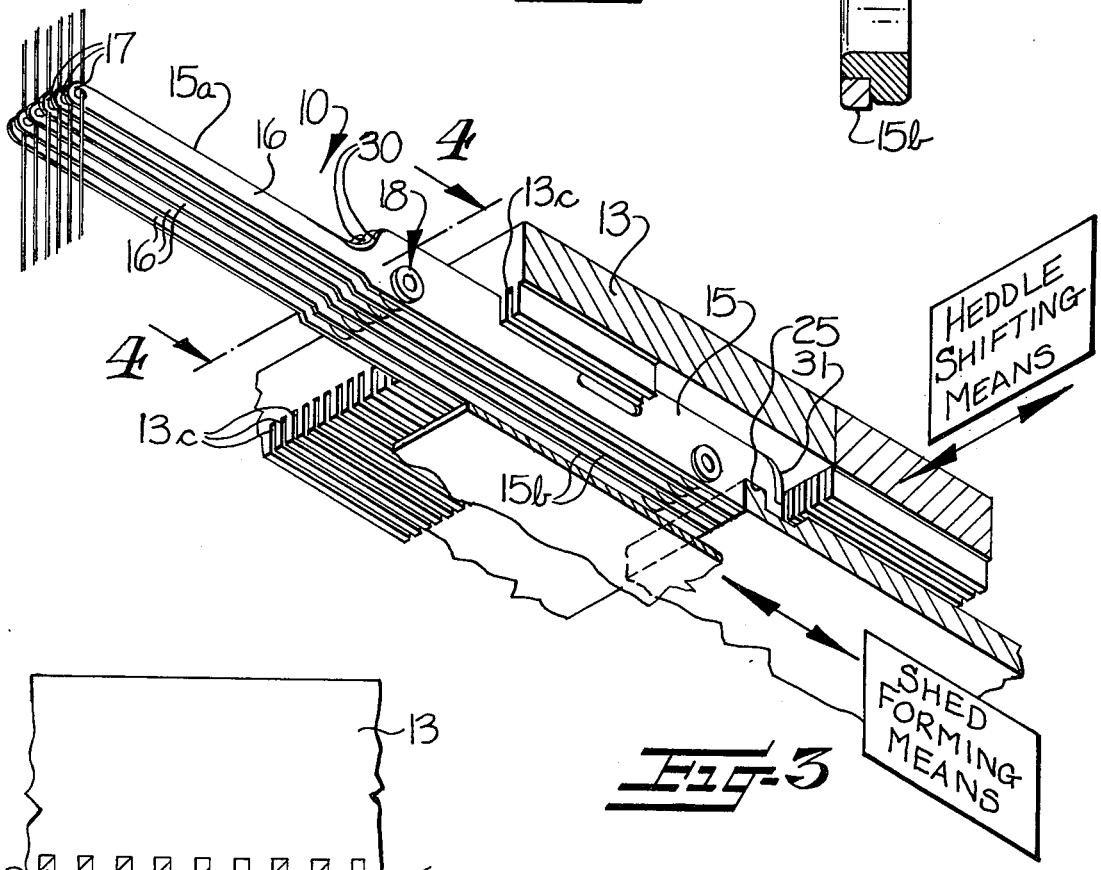
FIG. 3 is a perspective view of a series of adjacent heddles of the present invention as arranged in a weftwise row in a triaxial weaving machine.

In use, and as described more fully in aforementioned copending application Ser. No. 603,657 now U.S. Pat. No. 3,999,578 which is hereby incorporated by reference into this description to the extent necessary for full understanding of this invention, the heddle 10 is arranged in a weftwise row with other heddles received in guiding passageways 13*c* of a stationary guide means 13 used in a weaving machine (FIGS. 3 and 4). It is to be noted that the weftwise lateral projection of the button means is less than the normal weftwise spacing between adjacent heddles, so as to normally avoid frictional engagement between the laterally projecting means and an opposing planar surface area of an adjacent heddle. However, the clearance space therebetween, with the heddles an normal weftwise array, is less than the widthwise spacing of the guide passageways 13*c*, so as to preclude the possibility of adjacent heddles moving so far out of parallel relation as would lead to attempted insertion of two heddles into a single common passageway.

In the drawings and specification, there has been set forth a preferred embodiment of the invention, and although specific terms are employed, they are used in a generic and descriptive sense only and not for purposes of limitation.

That which is claimed is:

1. In a weaving machine for making triaxial fabric and having a plurality of elongate heddles arranged in weftwise rows for guiding respective warp strands, means for longitudinally moving said heddles for forming the warp strands guided thereby into warp sheds, means defining passageways for guiding said heddles during longitudinal movement, and means for moving said heddles and the warp strands guided thereby weftwise during weaving to shift heddles from one passageway to another and to move the warp strands from one weftwise location to another, each of said heddles having a body portion and an elongate reduced width frontal portion for engagement with a warp strand, the improvement in said heddles which comprises each of said heddles having means on said body portion thereof spaced from said frontal portion and for preventing entrance of more than one heddle into the same passageway.

2. A weaving machine according to claim 1 wherein said means on said heddles for preventing entrance comprises means projecting laterally and adapted to engage an adjacent heddle.

3. A weaving machine according to claim 2 wherein said means projecting laterally comprises a plurality of projections spaced one from another longitudinally along said heddle.

4. A weaving machine according to claim 2 wherein said means projecting laterally comprises a plurality of button means secured to said body portion.

5. A weaving machine according to claim 1 wherein each of said heddles is formed of strip material and has substantially planar side faces and further wherein said means for preventing entrance comprises means projecting laterally outwardly from only one side face of each said heddle.

6. A weaving machine for making triaxial fabric and comprising a plurality of elongate heddles arranged in weftwise rows for guiding respective warp strands, means for longitudinally moving said heddles to and from extended and retracted open shed positions for forming the warp sheds guided thereby into warp sheds, means defining passageways for guiding said heddles during longitudinally movement, and means for moving said heddles and the warp strands guided thereby weftwise during weaving to shift heddles from one passageway to another and to move the warp strands from one location to another, each of said heddles having an elongate reduced width frontal portion and a body portion for sliding engagement with said passageways, each of said body portions having opposing, spaced apart longitudinally extending parallel edges defining a principal plane of said heddle and means projecting laterally from said body portion for preventing entrance of more than one heddle into the same passageway.

7. A weaving machine according to claim 6 wherein said means projecting laterally is spaced widthwise of said body portion in substantial longitudinal alignment with said reduced width frontal portion.

8. A weaving machine according to claim 6 wherein said frontal portion has one longitudinally extending edge aligned with one of said parallel edges of said body portion, and said body portion has a front shoulder edge and a rear edge at opposite ends of the other of said parallel edges of said body portion, and further wherein said means projecting laterally is spaced longitudinally of said body portion inwardly of and adjacent both said front shoulder and rear edges.

9. A weaving machine according to claim 6 wherein said means projecting laterally is formed of a material having a hardness less than that of the material of said body portion so as to facilitate minimizing wear of the body portion.

* * * * *